US006254493B1

(12) United States Patent
Wurster

(10) Patent No.: US 6,254,493 B1
(45) Date of Patent: Jul. 3, 2001

(54) GOLF SWING TRAINING DEVICE AND METHOD

(75) Inventor: Robert L. Wurster, Burbank, CA (US)

(73) Assignee: Lazereyes Golf, LLC, Burbank, CA (US)

( * ) Notice: Subject to any disclaimer, the term of this patent is extended or adjusted under 35 U.S.C. 154(b) by 0 days.

(21) Appl. No.: 09/373,159

(22) Filed: Aug. 12, 1999

Related U.S. Application Data

(63) Continuation-in-part of application No. 09/033,438, filed on Mar. 2, 1998.
(60) Provisional application No. 60/038,564, filed on Mar. 3, 1997.

(51) Int. Cl.[7] ..... A63B 69/36
(52) U.S. Cl. ..... 473/220
(58) Field of Search ..... 473/219, 220, 473/221; 273/186.3

(56) References Cited

U.S. PATENT DOCUMENTS

| | | | | |
|---|---|---|---|---|
| 3,909,005 | * | 9/1975 | Piszel . | |
| 4,911,450 | * | 3/1990 | Rabold | 473/220 |
| 5,082,282 | * | 1/1992 | Hernberg | 473/220 |
| 5,161,802 | * | 11/1992 | Daechsel | 473/220 |
| 5,470,072 | | 11/1995 | Cunningham | 273/186.3 |
| 5,482,283 | * | 1/1996 | Wall | 473/220 |
| 5,593,354 | | 1/1997 | Falossi et al. | 473/220 |
| 5,897,441 | | 4/1999 | Apthorp | 473/220 |

* cited by examiner

*Primary Examiner*—Mark S. Graham
*Assistant Examiner*—Raeann Gorden
(74) *Attorney, Agent, or Firm*—Lyon & Lyon LLP

(57) ABSTRACT

The golf swing training device has a foreshortened shaft, a grip mounted on the upper end of the shaft, a head mounted on the lower end of the shaft, a first laser module mounted in the grip end of the shaft for directing a laser beam upwardly from the grip in co-axial alignment with the central axis of the shaft, and a pair of laser modules mounted in the head of the training device for directing a pair of spaced parallel laser beams downwardly from the head in a diametrically opposed direction from the beam emanating from the grip. The two beams projecting from the head of the training device are disposed in a common plane with a downward extension of the central axis of the shaft such that a line drawn between the points of impact of the beams on the ground visually defines the footprint and thus the angular orientation of an imaginary club face. The laser carrying head is configured so that it can not be used to strike a golf ball. The training device also includes a momentary on-off switch mounted in the grip for activating the laser modules upon the golf training device being held in a conventional golf grip. The method includes gripping the golf training device and performing a golf swing while observing the laser beams to train a consistent golf swing.

20 Claims, 6 Drawing Sheets

FIG. 3A
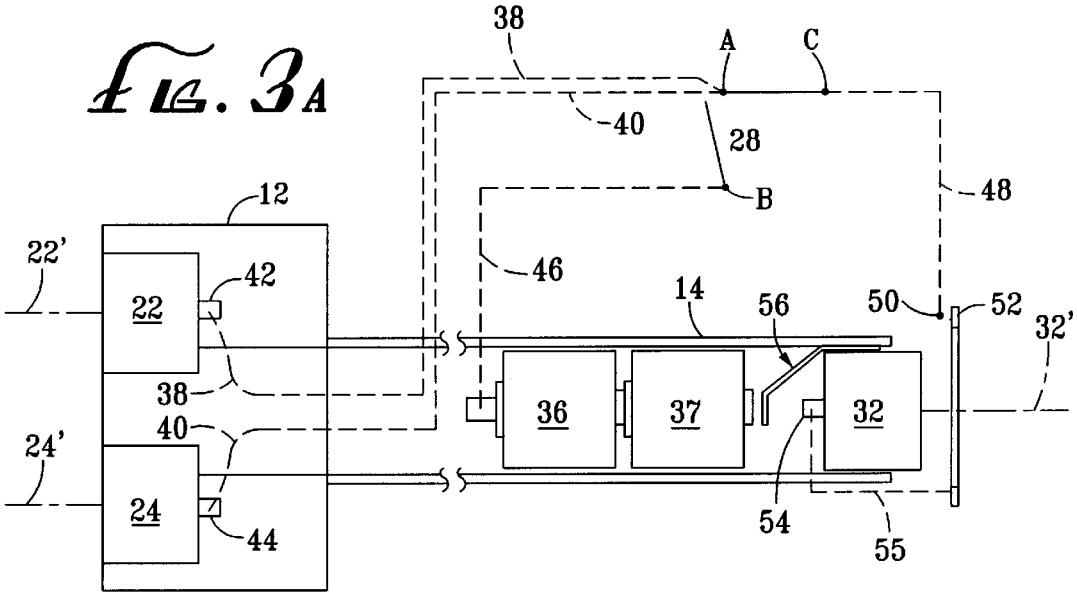
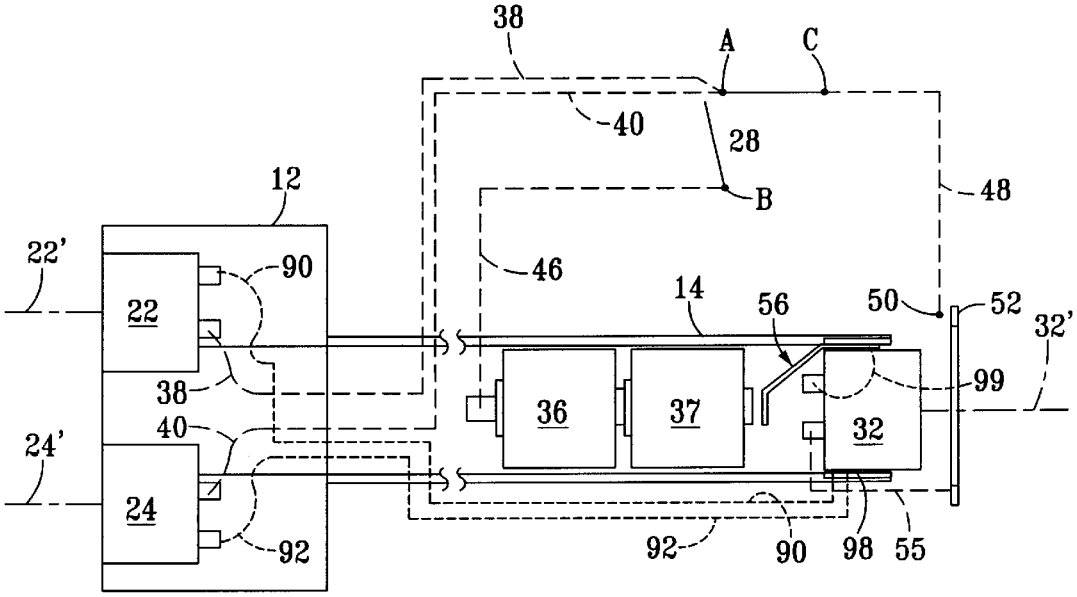
FIG. 3B

GOLF SWING TRAINING DEVICE AND METHOD

This is a continuation-in-part of application Ser. No. 09/033,438 filed on Mar. 2, 1998 and entitled Dual Ended Laser Swing Aid, which is based for priority on Provisional Patent Application No. 60/038,564, filed Mar. 3, 1997.

BACKGROUND OF THE INVENTION

The present invention relates to training devices which assist a golfer in learning to correctly swing a golf club and a training method using such devices. More particularly, the invention relates to golf swing training devices equipped with a plurality of lasers to provide an optical indication of the complete swing path action of a golf club, including the take-away, back swing and down swing as well as the orientation of the club face during the swing.

Training aids designed to assist golfers in developing a proper golf swing have included arm braces, gloves, tubular tracks and many other devices. More recently, optical devices using lights and lasers have been proposed. An example of such a device is found in U.S. Pat. No. 5,848,941 issued to Morra which, although not prior art, discloses a particularly configured golf club having two small lights or lasers pointed in axially opposed directions, one being mounted in the upper end of the shaft and the other in the club head. By viewing the paths of light emanating from the club head and grip while striking a ball, the path of the club during the swing is visually represented. This allows one to see the variances in their swing from a proper swing plane and thus assists the golfer in learning how to correct his or her swing. However, the inclusion of the golf club head on the device may obscure the laser beam emanating from the lower end of the shaft and the shock of the impact of the head with a golf ball is likely to quickly damage the laser module in the club head. Another swing training device employing opposed lasers is found in applicant's copending application Ser. No. 09/033,438 entitled Dual Ended Laser Swing Aid. In that device, the shaft is shortened from the length of a regular golf club so that the head of the device will not visually obstruct the path of light emanating from the lower laser at the point of impact. The head on the device is configured so that it can not be used to actually strike a ball and is particularly weighted to give the foreshortened device the weight and balance of a conventional golf club.

While the aforesaid devices are very useful in teaching one the proper swing plane of a golf club, they do not provide the user with any feedback regarding the angular orientation of a club head during the swing. It is well known that even if a club is swung on a proper plane, an open club face at the point of impact with the ball will cause a ball to fade or even slice and a closed club face will cause the ball to draw or hook. Thus, while the instructional devices heretofore available may teach one how to swing the club on plane, they do not tell the user whether or not their club head would be square to the ball at impact which is necessary to execute a straight shot. It would be highly desirable if a golf swing training device not only enabled the golfer to visualize the golf club path to perfect a proper swing plane, but also provides the golfer with a visual representation of the orientation of the club head during the swing and, most importantly, through the point of impact with a ball. Such a device is found in the present invention.

SUMMARY OF THE INVENTION

Briefly, the golf swing training device of the present invention comprises a foreshortened shaft, a grip mounted on the upper end of the shaft, a head mounted on the lower end of the shaft, a first laser module mounted in the grip end of the shaft for directing a laser beam upwardly from the grip in co-axial alignment with the central axis of the shaft, and a pair of laser modules mounted in the head of the training device for directing a pair of spaced laser beams, preferably parallel, downwardly from the head in a diametrically opposed direction from the beam emanating from the grip. The two beams projecting from the head of the training device are disposed in a common plane with a downward extension of the central axis of the shaft such that a line drawn between the points of impact of the beams on the ground visually defines the footprint and thus the angular orientation of an imaginary club face. The shaft on the training device is substantially shorter than a conventional golf club shaft so that head is elevated from the ground so as not to obscure the golfer's view of the laser beams through the point of impact. The laser carrying head is preferably configured so that it can not be used to strike a golf ball which would damage the laser modules mounted therein and is weighted so as to give the training device with its foreshortened shaft the weight and balance of a conventional golf iron. The training device also includes a momentary on-off switch mounted in the grip for activating the laser modules upon the golf training device being held in a conventional golf grip.

The method of the present invention includes gripping the golf training device of the present invention and holding the training device in the customary "address" position, whereby the two lasers in the head will direct beams of light against the ground at the location where a golf ball would be if one were going to actually hit a ball with a conventional club. An imaginary line between the two illuminated dots (where the laser beams strike the ground) provides a visual indication of the angular orientation of an actual club face at the address position. By holding the training device with a conventional golf grip at the ball address position such that this imaginary line is square to the intended direction of ball flight and swinging the device in the same manner as one would swing a conventional club, a visual representation of the swing and club head orientation is provided to the golfer by the three lasers.

During the back swing of the training device, the laser beams emanating from the head and striking the ground will visually illustrate the path of the take-away portion of the swing and the orientation of the club head during the take-away. As the swing continues rearwardly, the single laser beam emitted from the grip end of the shaft illustrates the target or take-away line and thus cooperates with the two lasers in the head to define the swing plane of the rearward portion of the golf swing. On the down swing, the grip laser shows the target line and in cooperation with the two head lasers, illustrates the swing plane of the down swing. At the finishing point of the down swing, before impact with an imaginary ball and prior to the follow through, the two head lasers will not only show the swing plane line through the target line to impact, they also provide a visual representation of the orientation of a club face with respect to the ball location as the golfer swings the training device through the imaginary point of impact, thus also providing the golfer with information regarding the positioning of the hands through the swing. Finally, the path of the club at the "finish" of the swing is illustrated by the grip laser as its beam passes through the contact area. As a golfer should always look at the ball until impact, the golfer alone can observe all of the laser tracks provided by the training device through the impact area with or without the help of a video camera. If the laser lines do not conform to the correct paths and alignment, the golfer has a set of diagnostics on how to correct the various parts of the golf swing.

It is therefore the principal object of the present invention to provide an improved training device which assists the golfer in correcting his or her golf swing.

It is a another object of the present invention to provide a golf swing training device which provides a continuous indication of the location and attitude of the grip and head of the golf club during a complete golf swing to provide a visual representation of the swing path of the club to assist the golfer in perfecting his or her swing.

It is a further object of the present invention to provide a golf swing training device which tracks the angular orientation of the club face produced by the swing through the point of impact to assist the golfer in learning the proper use of his or her hands and wrists during the swing.

It is another object of the present invention to provide a golf swing training device which has the weight and balance of a conventional golf club and provides an unobstructed visual representation of the swing path and angular orientation of the club face throughout the golf swing.

It is still another objection of the present invention to provide a golf swing training device which is self-acting, portable and suitable for golfers of all sizes, ages, right-handed or left-handed, and both genders.

It is yet another object of the present invention to provide a golf swing training device which is rugged, economical to manufacture, and simple to use both indoors or outdoors.

These and other objects and advantages of the present invention will become readily apparent from the following detailed description of the accompanying drawings.

BRIEF DESCRIPTION OF THE DRAWINGS

FIG. 3A is a circuit diagram showing the electrical connections of the laser modules in a first embodiment of the invention wherein the shaft is employed as an electrical conductor.

FIG. 3B is a circuit diagram showing the electrical connections of the laser modules in a second embodiment of the invention wherein the shaft is not employed as an electrical conductor.

DESCRIPTION OF THE PREFERRED EMBODIMENT

Referring now in detail to the drawings, the golf swing training device 10 of the present invention comprises a head 12, shaft 14 and grip 16. The head 12 is a solid mass, preferably of a cylindrical configuration so that it seriously discourages its use to actually strike a golf ball but properly weighted so as to give the golf swing training device 10 the weight and balance of a conventional golf iron.

Figure 1:
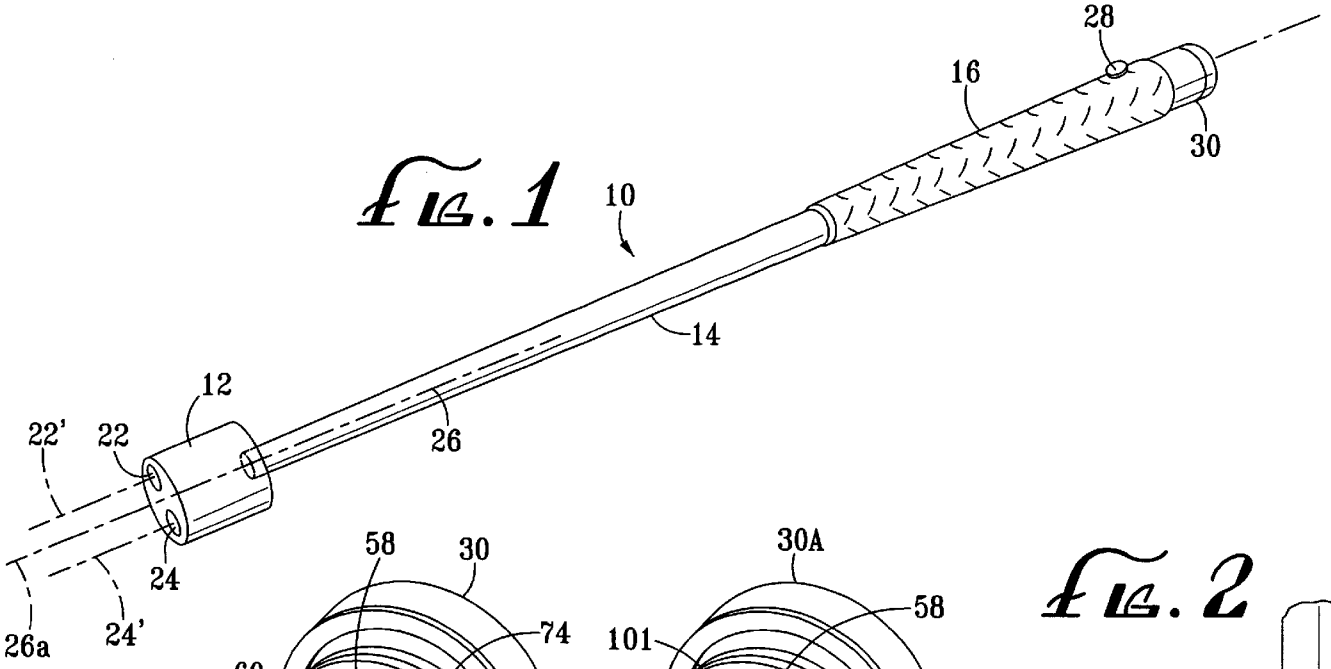
FIG. 1 is a perspective view of the golf swing training device of the present invention.
Figure 2:
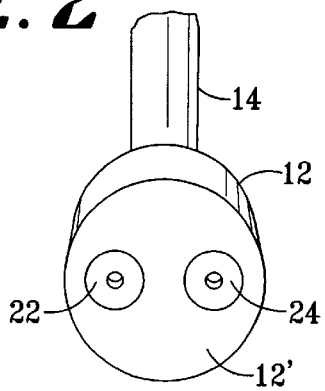
FIG. 2 is a partial perspective view of the golf swing training device of the present invention.

The head 12 of training device 10 defines a pair of cylindrical channels 18 and 20 therein for housing a pair of head laser modules 22 and 24. A suitable laser module that is currently being utilized in the training device is a Class 3A laser, 645 nm, manufactured by Syndex Technical Supplies, Ltd. of Taiwan but any appropriate laser may be used. The channels 18 and 20 in which the head laser modules are mounted extend into the head 12 from the lower end 12' thereof and preferably are in parallel alignment and coplanar with a projected extension 26*a* of the central axis 26 of the shaft 14 as illustrated in FIG. 1. The laser modules 22 and 24 are held within channels 18 and 20 respectively by press fitments and thereby positioned such that the laser beams 22' and 24' emanating from the head lasers will project from the lower end 12' of head 12 through the open channel ends in a spaced parallel relationship with the parallel beams also being parallel to and coplanar with the forward extension 26*a* of the central axis 26 of shaft 14. As an alternative, one or both of the laser modules 22 and 24 may be positioned to point the laser beam 22' and/or 24' at an angle to the extension 26*a* of the axis 26 of shaft 14, such as, for example, at a small angle to but coplanar with extension 26*a*, or both laser beams 22' and 24' at the same angle slightly forward of extension 26*a*, or the like, such that a plane or line is created by or between the two laser beams 22' and 24' that may be observed by the golfer while practicing his or her golf swing with the device 10. In the preferred embodiment, head 12 is formed by injection molding or casting and small tapered fins (not shown) are provided to form the press fitments of the laser modules within the channels and provide electrical ground contacts between the outer casings of the laser module and the head 12 when necessary, as will be explained.

The shaft 14 utilized in the present invention preferably is a foreshortened conventional hollow golf club shaft of about 24 to 30 inches in length, although any hollow shaft could be used. In a first embodiment of the invention, the shaft 14 is utilized as an electrical conductor and is thus formed of metal. In a second embodiment of the invention, the shaft is not so utilized and can be constructed of any suitable material. The shaft 14 is secured to the cylindrical head 12 by any suitable securement means. Threaded engagements of the shafts and heads are illustrated in FIGS. 4A and 4B.

A conventional golf grip appearance and material is provided on the exterior of grip 16 which has the closed end portion removed and is disposed about the upper end portion of shaft 14 as seen in FIG. 1. Protruding from the external surface of grip 16 is a momentary on-off switch 28 which is convenient relative to the golfer's hands such that when the training device 10 is held by a golfer in a conventional golf grip, switch 28 will be depressed to close the D.C. electrical circuit inside shaft 14 and activate the laser beams in a manner to be discussed. For safety reasons, switch 28 is spring loaded and must be held in a depressed state for the lasers to activate. When the golfer removes his hands from the grip and releases the switch, the switch will open the D.C. circuit and deactivate the lasers.

A grip knob 30 is attached to the free end of the shaft 14 which houses a grip laser module 32 which generates a grip laser beam 32'. The grip knob 30 is removably attached to the upper end of the shaft for installation of the D.C. power to activate the laser modules 22, 24 and 32.

Figure 4A:
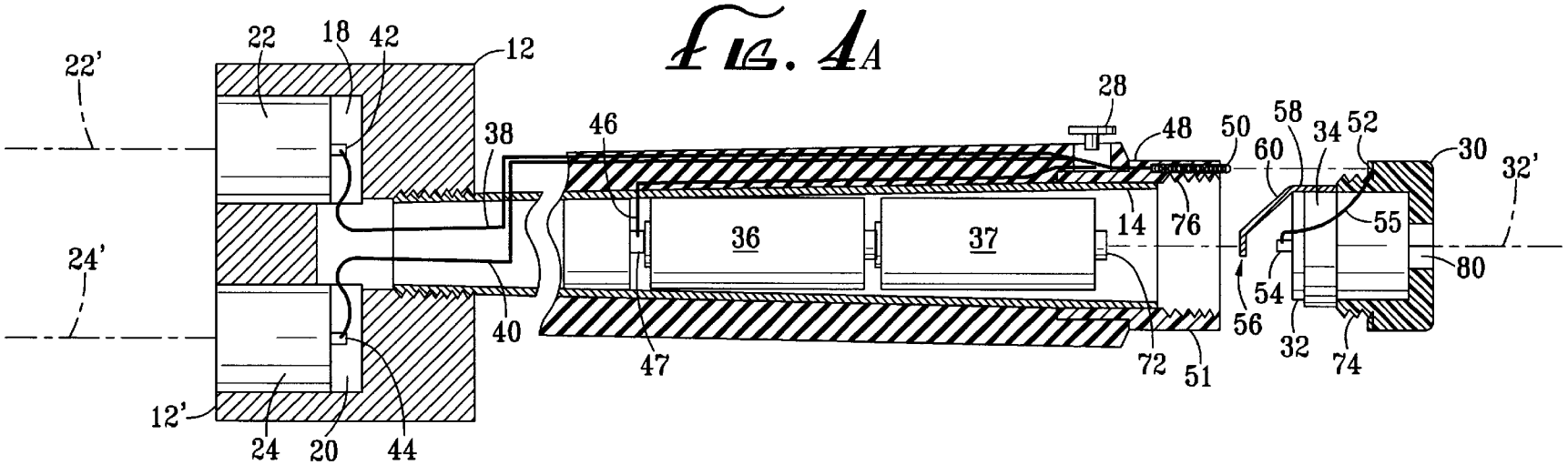
FIG. 4A is a partial sectional view of the golf swing training device of the present invention showing the electrical connections of the laser modules in the first embodiment of the invention.
Figure 4B:
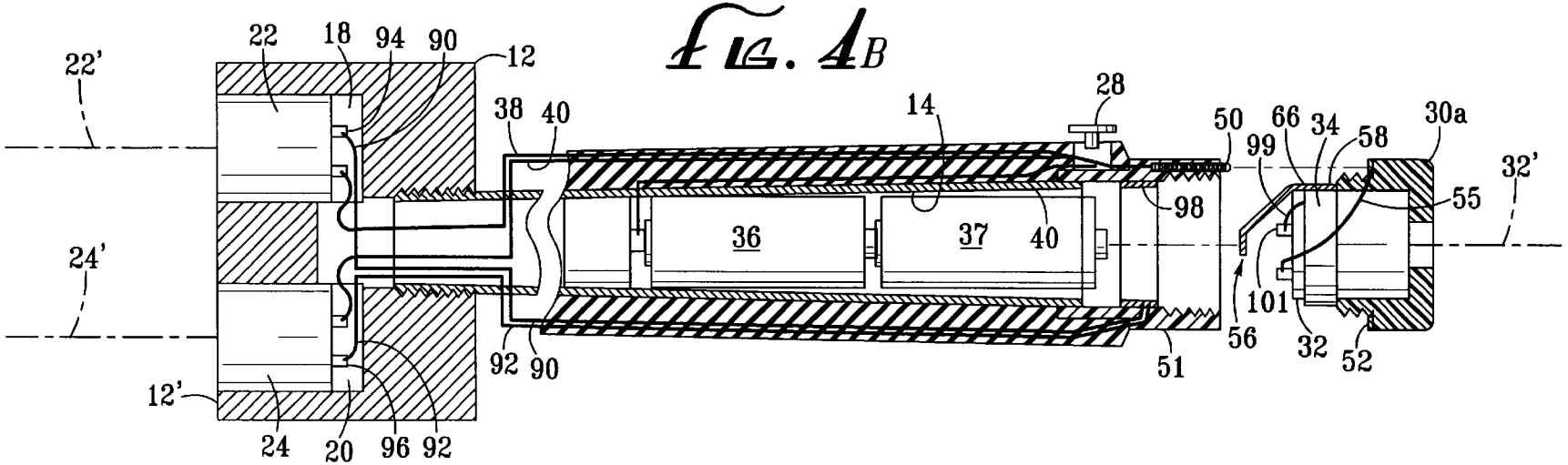
FIG. 4B is a partial section view of the golf swing training device of the present invention showing the electrical connections of the laser modules in the second embodiment of the invention.

Referring to FIGS. 3A and 4A, a circuit diagram and an exploded cross-sectional view of the first embodiment of the invention are shown wherein the D.C. power source for the laser modules is provided by a pair of 1.5 volt batteries 36 and 37 mounted in series in the upper end of shaft 14. The head laser modules 22 and 24 are in electrical communication with batteries 36 and 37 via hot wires 38 and 40 (or alternatively both laser modules connected to a single common wire) which are connected to and extend from the negative hot terminals 42 and 44 of laser modules 22 and 24 respectively, through grip 16 to bridging terminal A of switch 28 (See FIG. 3A). Battery hot wire 46 is affixed to and extends from a connector 47 in electrical communication with the negative pole of lower battery 36 to D.C. power source terminal B of switch 28. Switch wire 48 extends from terminal C of switch 28 to an electrically conductive pin or coil spring 50 mounted in a shaft fitting 51 on the upper end of grip 16 and projecting slightly therefrom as seen in FIG. 4A. When the grip knob 30 is mounted on shaft fitting 51, coil spring 50 is pressed against and in electrical communication with an annular conductor ring 52 on grip knob 30. Ring 52 is in electrical communication with the negative hot terminal 54 of grip laser module 32 via hot wire 55.

Figure 5B:
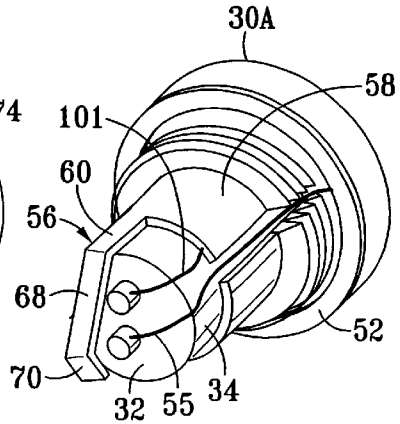
FIG. 5B is a perspective view of the grip end cap and laser assembly employed in the second embodiment of the present invention.
Figure 5A:
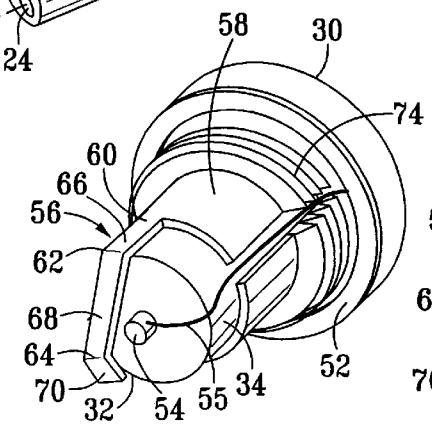
FIG. 5A is a perspective view of the grip end cap and laser assembly employed in the first embodiment of the present invention.

The grip knob 30 also includes a ground circuit completion spring 56 which, as seen in FIGS. 4A and 5A, defines an annular slotted base portion 58 and arm portion 60. As best seen in FIG. 5A, the base portion 58 extends about and grips the positive ground case 34 of grip laser module 32. Arm portion 60 projects downwardly adjacent laser module 32, bends inwardly at 62 and again at 64 to define an axially extending arm portion 66, an inclined arm portion 68 and a radial arm portion 70. Through such a configuration, the circuit completion spring 56 electrically communicates the positive ground case 34 of laser module 32 with the electrically conductive shaft 14 along the axially extending arm portion 66 of the spring and with the positive ground pole 72 of upper battery 37 via the radial arm portion 70 of circuit completion spring 56. The positive ground of the D.C. circuit is completed by the electrical communications between the positive ground casings of head laser modules 22 and 24, head 12 and shaft 14. The momentary switch 28 closes and opens the D.C. circuit at terminals A and B, as shown in FIG. 3A. Finally, grip knob 30 is preferably provided with external threads 74 on a reduced diameter portion of the knob adjacent conductor ring 52 which threadably engage internal threads 76 in the shaft fitting 51 on the upper end of grip 16 to provide the detachable connection of the grip knob. A centrally disposed aperture 80 is provided in the end surface of grip knob 30 to allow for the passage of the grip laser beam 32' therethrough.

An alternate embodiment of the present invention is illustrated in FIGS. 3B, 4B and 5B wherein the shaft 14 is not utilized as an electrical conductor. The alternate embodiment of the present invention differs from the prior embodiment in that a pair of ground wires 90 and 92 (or alternatively a single, common wire) extend from ground connections 94 and 96 on the head laser modules 22 and 24 through shaft 14 and grip 16 to a ground ring contact 98 mounted in the shaft fitting 51 on the upper end of grip 16 in axial alignment with shaft 14. Ring contact 98 engages the axially extending portion 66 of the ground circuit completion spring 56 to effect the electrical communication of ground wires 90 and 92 with spring 56. Finally, a ground wire 99 provides an electrical communication between ground contact 101 on the grip laser module 32 and spring 56. In this embodiment, the head 12 and shaft 14 need not be of electrically conductive materials. The operation of the second embodiment of the device by switch 28 is identical to the operation of the prior embodiment.

Figure 6A:
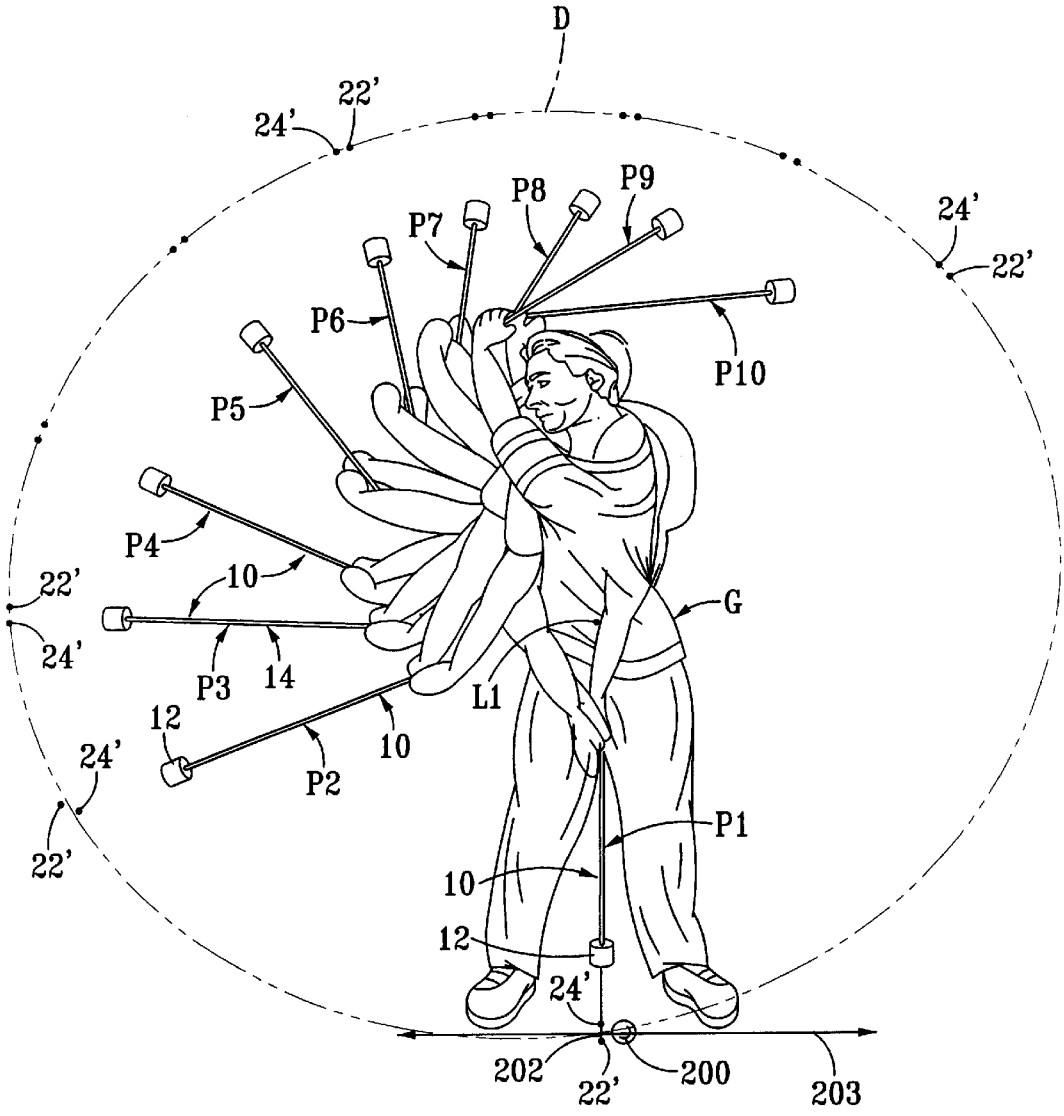
FIG. 6A is a pictorial view of a golfer utilizing the golf swing training device of the present invention and illustrating the traces of the pair of lasers in the head end of the device to provide a visual representation of the swing plane and the orientation of an imaginary club head.
Figure 6B:
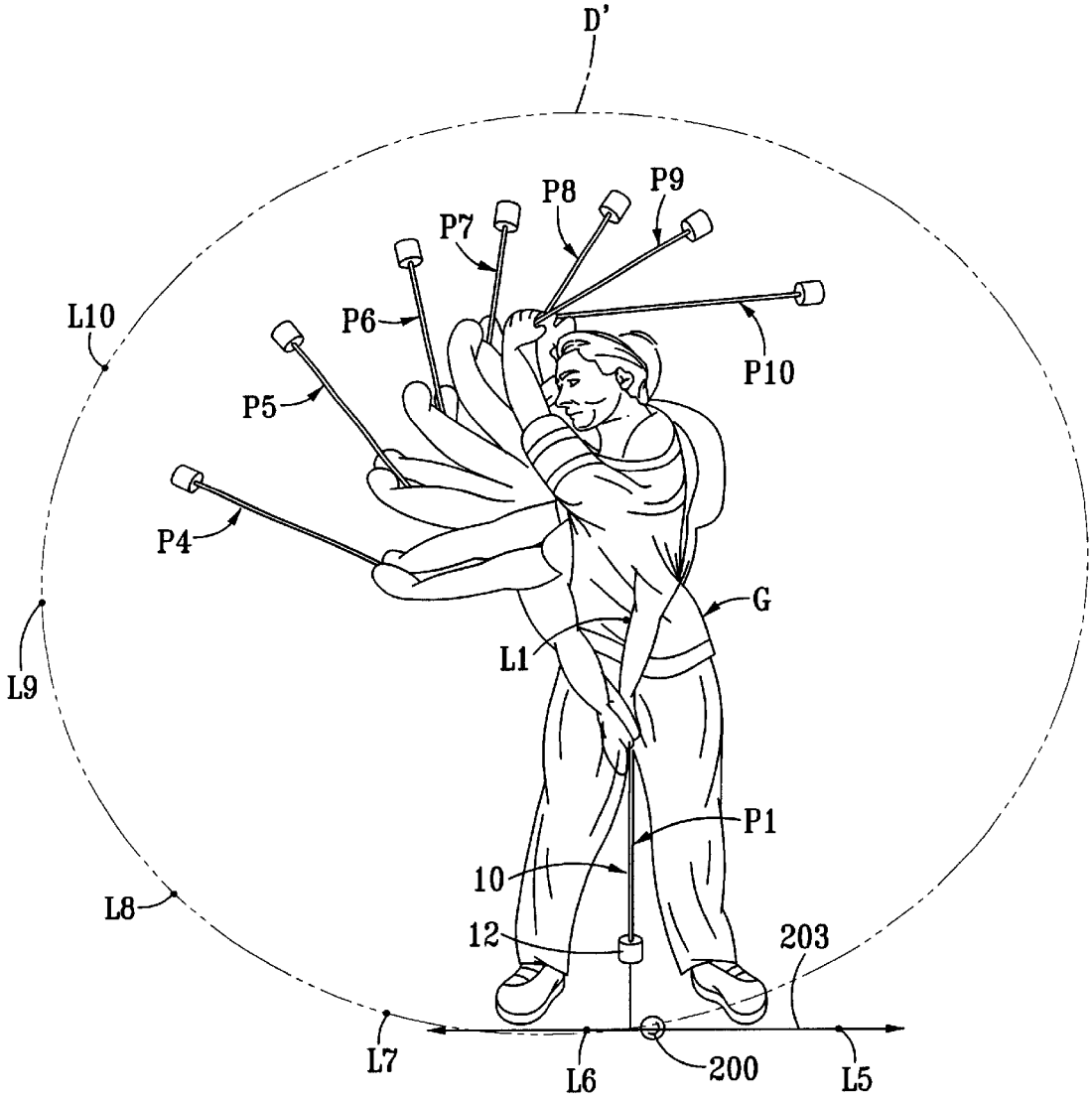
FIG. 6B is a pictorial view of a golfer utilizing the golf swing training device of the present invention and illustrating the trace of the single laser in the grip end of the device to provide a visual representation of the swing plane and the orientation of shaft.

The use of the golf training device 10 of the present invention is illustrated in FIGS. 6A and 6B, which separately illustrate the path of the pair of lasers beams 22' and 24' (FIG. 6A) and the single laser beam 32' (FIG. 6B) for clarity, although it will be understood that the paths of all three laser beams will be traced simultaneously in each golf swing. As shown in FIG. 6A, the golfer G is holding the training device 10 at the correct address position P1 with the laser head beams 22' and 24' oriented with respect to an imaginary ball 200, such that an imaginary straight line 202 drawn between the illuminated points of impact of laser beams 22' and 24' on the ground or floor is normal to the target line 203 and the intended flight path of the ball. It should be noted that for creating a larger separation of the points of contact on the ground of the laser beams 22' and 24', one or both of the laser modules 22 and 24 may be angled slightly away from axis extension 26*a* for thereby accentuating the position of the imaginary club face and making it more visible without making the head 12 larger. The orientation of the club face can also be seen by the relative positioning of the points of impact of laser beams 22' and 24' on the ground through the impact area, i.e., prior to and following the point of impact with a ball if an actual golf club were being used to strike a golf ball with the same swing. As the training device 10 is moved rearwardly in the take-away portion of the golf swing, the head 12 begins to rotate as the golfer's hands and arms rotate (as in a preferred golf swing) which is evident from the position P2 of the device and the laser beams 22' and 24' wherein the line 202 therebetween is no longer perpendicular to the target line 203 and is at a small angle to the dot-dash line D simulating the motion of an actual club head. As the backswing continues to position P3 where the shaft is approximately horizontal, the head 12 is rotated to a desired orientation where the line 202 between laser beams 22' and 24' is substantial vertical and coincident with the dot-dash line D. This orientation of the laser beams 22' and 24' relative to the dot-dash line D, i.e. both beams stay on the line D, preferably continues through the backswing in positions P4 through P10 and again in the downswing of positions P10 through P3, whereupon the head 12 starts turning back to the desired orientation of the line 202 between the laser beams 22' and 24' being perpendicular to the target line 203 and dot-dash line D. Thus, the golfer can see the results of his or her hand and wrist movements on the face of the club head and thereby learn the proper positioning of the hands and wrists during this critical portion of the swing. By practicing with the golf training device indoors or proximate front and rear walls and a ceiling or overhead wall, one can view the orientation of the club face throughout the entire swing as is pictorially represented by the pairs of dots along the dot-dash line in FIG. 6A.

Referring now to FIG. 6B, the path of the single grip laser beam 32' is illustrated for the relevant positions corresponding to the like-numbered positions in FIG. 6A. At the address position P1, the laser beam 32' assumes a location 11 on the golfer's midsection. During the start of the take-away, the location of laser beam 32' is above and forward of the golfer and unrelated to the various positions of the pair lasers 22' and 24' during the golf swing. As the shaft 14 of training device 10 passes horizontal to position P4 and beyond the laser beam 32' will become visible and at position P5 the location L5 of the laser beam 32' is preferably on the target line 203. During the continued backswing through positions P6–P10 the laser beam 32' will be at the locations L6–L10, respectively, on a swing path of dot-dash line D' that preferably is substantially the same as dot-dash line D of FIG. 6A. In other words the grip laser beam 32' should trace the same path as the head laser beams 22' and 24' through those portions of the swing path in which the laser beams overlap thereby assuring a consistent and preferred golf swing.

Figure 7B:
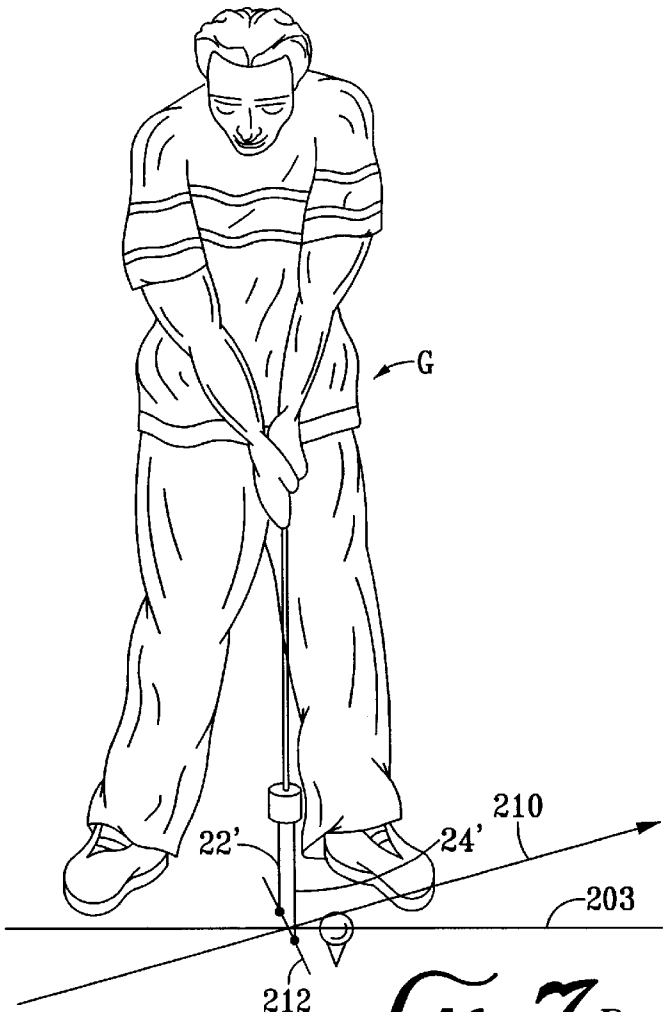
FIG. 7B is a pictorial view of a golfer illustrating the golf swing training device of the present invention at the point of impact with the club head misaligned in a closed position.
Figure 7A:
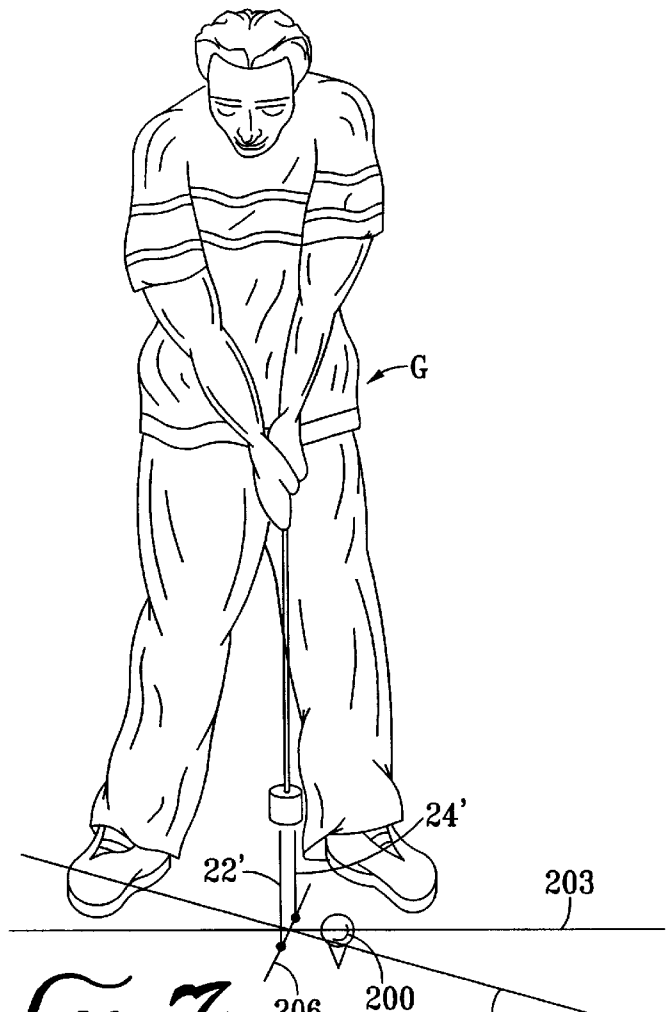
FIG. 7A is a pictorial view of a golfer illustrating the golf swing training device of the present invention at the point of impact with the club head misaligned in an open position.

FIGS. 7A and 7B illustrate the visual representation of improper club head alignment at address provided by the golf training device 10. As seen in FIG. 7A, laser beam 24' is ahead of laser beam 22' such that an imaginary line 206 drawn therebetween is not normal to the target line 203 but is normal to a line 208 pointed outside the target line, indicative of an open club face which can produce a fade or slice. In FIG. 7B, the imaginary line 210 normal to the line 212 drawn between the points of impact of laser beams 22' and 24' on the ground indicates a closed club face which can produce a draw or hook. By practicing one's swing with device 10, the desired square club face orientation illustrated in FIG. 6 can be more readily learned. In addition, slightly open and closed club face positions can also be learned to teach one how to fade or draw a golf ball.

In addition to providing a visual representation of the club face during the golf swing, the head and grip laser modules also provide a pictorial representation of the entire swing to assist the golfer in learning the proper club orientation or swing plane of the club during the swing. In the correct take-away position, the head laser beams 22' and 24' will indicate a straight take-away line during the initial motion of the back swing and thus follow the rearward extension of imaginary line 202 of the FIG. 6. During the back swing, the grip laser beam 34 should trace a line which coincides with the same path followed by the head lasers thereby illuminating a path which traces out the path of a club head during the back swing so that by following the paths traced by the head and grip laser beams, the proper back swing can be learned. During the down swing, the grip laser should trace a path which coincides with the original back swing line which should then be followed by the head laser beams. Thus, the golfer can utilize the training device 10 to practice the entire swing or to concentrate only on the portion of his or her swing which deviates from the correct motion. Repeated swings with the training device 10 will serve to remedy any bad habits and the golfer can do so alone whenever and wherever it is convenient. Installation and exchange of the batteries 36 and 37 is also made easy and straightforward by the provision of the readily detachable and replaceable grip knob 30 and the ground circuit completion spring 56 employed therein.

Various changes and modifications may be made in carrying out the present invention without departing from the spirit and scope thereof. Insofar as these changes and modifications are within the purview of the appended claims, they are to be considered as part of the present invention.

What is claimed is:

1. A golf swing training device for a golfer comprising:

a shaft defining a longitudinal axis extending therethrough and having first and second ends with a hand grip on the first end and a head on the second end;

a pair of lasers mounted in the head in a spaced relationship and oriented so as to emit a pair of parallel laser beams projecting in a direction away from the second end of said shaft so as to strike the ground during a golf swing, said beams being parallel to, spaced from opposed sides of, and lying in a common plane with an extension of said longitudinal axis of said shaft in said direction away from the second end of said shaft, and wherein said plane is coincident with a straight line extending between the points of intersection of said laser beams with the ground and oriented relative to the ground such that said straight line is perpendicular to a desired target line and representative of the orientation of a face of a golf club during a golf swing; and an electrical power source and circuit mounted in the device for selectively operating said pair of lasers for the golfer to practice golf swings by observing the alignment of said plane to the desired target line during at least a portion of the golf swing.

2. The device of claim 1 further comprising a spring biased switch disposed within said hand grip for selectively activating said pair of lasers, said switch being actuated to an on position upon the golfer gripping the hand club for performing the practice swing and de-actuated to an off position upon the golfer releasing the hand grip.

3. The device of claim 1 further comprising a third laser mounted in the grip and oriented so as to emit a third laser beam in a direction away from the first end of said shaft, said third laser beam being parallel to said first pair of laser beams and coincident with of said longitudinal axis of said shaft whereby observing the path of said third laser relative to the paths of said pair of lasers during the golf swing allows the golfer to determine whether the hand grip and head of the training device continuously lie in a common plane during the golf swing.

4. The device of claim 3 further comprising a spring biased switch disposed within said hand grip for activating said pair of lasers, said switch being actuated to an on position upon the golfer gripping the hand club for performing the practice swing and de-actuated to an off position upon the golfer releasing the hand grip.

5. The device of claim 1 wherein said head is of a shape without a flat surface for hitting a golf ball.

6. The device of claim 1 wherein said head, shaft and grip are of a total length substantially less than the distance to the ground when the golfer grips the hand grip in a stance for taking the practice golf swing.

7. The device of claim 1 wherein said shaft is hollow and said electrical power source and circuit include at least one battery mounted in the shaft and at least one wire connecting said battery to said pair of lasers.

8. The device of claim 7 wherein said shaft is metallic and said electrical power source and circuit includes said shaft as one electrical connection between said battery and said pair of lasers.

9. The device of claim 7 wherein said electrical power source and circuit includes separate positive and negative wires extending through said hollow shaft and connecting said battery to said pair of lasers.

10. A golf swing training device for a golfer comprising:

a shaft defining a longitudinal axis extending therethrough and having first and second ends with a hand grip on the first end and a head on the second end;

a pair of lasers mounted in the head in a spaced relationship and oriented so as to emit a pair of parallel laser beams projecting in a direction away from the second end of said shaft so as to strike the ground during a golf swing, said beams being parallel to, spaced from opposed sides of, an lying in a common plane with an extension of said longitudinal axis of said shaft in said direction away from the second end of said shaft, and wherein said plane is coincident with a straight line extending between the points of intersection of said laser beams with the ground and oriented relative to the ground such that said straight line is perpendicular to a desired target line and representative of the orientation of a face of a golf club during a golf swing;

a third laser mounted in the grip and oriented so as to emit a third laser beam in a direction away from the first end of said shaft, said third laser beam being parallel to said first pair of laser beams and coincident with said longitudinal axis of said shaft whereby observing the path of said third laser relative to the paths of said pair of lasers during the golf swing allows the golfer to determine whether the hand grip and head of the training device continuously lie in a common plane during the golf swing;

an electrical power source and circuit mounted in the device for selectively operating said pair of lasers for the golfer to practice golf swings by observing the alignment of said plane to a desired target line during at least a portion of the golf swing; and a switch disposed within said hand grip for activating said lasers.

11. The device of claim 10 wherein said switch is spring biased and projects from said hand grip such that upon the golfer gripping the hand club for performing the practice swing said switch is actuated to an on position and upon releasing the golf grip the switch is de-actuated to an off position.

12. The device of claim 11 wherein said head is of a cylindrical configuration having a central axis extending therethrough coincident with said longitudinal axis of said shaft thereby rendering said head without a flat surface for hitting a golf ball.

13. The device of claim 11 wherein said head, shaft and grip are of a total length substantially less than the distance to the ground when the golfer grips the hand grip in a stance for taking the practice golf swing.

14. A golf swing training device for a golfer comprising:

a shaft defining a longitudinal axis extending therethrough and having first and second ends with a hand grip on the first end and a head on the second end, said head, shaft and grip being of a total length substantially less than the distance to the ground when the golfer grips the hand grip in a stance for taking the practice golf swing;

a pair of lasers mounted in the head in a spaced relationship and oriented so as to emit a pair of parallel laser beams disposed in a common plane and projecting in a direction away from the second end of said shaft so as to strike the ground during a golf swing, said beams being parallel to an extension of said longitudinal axis of said shaft in said direction away from the second end of said shaft, and wherein said plane is coincident with a straight line extending between the points of intersection of said laser beams with the ground and oriented relative to the ground such that said straight line is perpendicular to a desired target line and representative of the orientation of a face of a golf club during a golf swing;

an electrical power source and circuit mounted in the device for selectively operating said pair of lasers for the golfer to practice golf swings by observing the alignment of said plane to the desired target line during at least a portion of the golf swing; and a switch disposed within said hand grip and projecting laterally therefrom for selectively activating said pair of lasers.

15. The device of claim 14 wherein said switch is spring biased and projects from said hand grip such that upon the golfer gripping the hand club for performing the practice swing said switch is actuated to an on position and upon releasing the golf grip the switch is de-actuated to an off position.

16. The device of claim 14 wherein said laser beams are disposed on opposed sides of said extension of said longitudinal axis and further comprising a third laser mounted in the grip and oriented so as to emit a third laser beam in a direction away from the first end of said shaft, said third laser beam being parallel to said first pair of laser beams and coincident with said longitudinal axis of said shaft whereby observing the path of said third laser relative to the paths of said pair of lasers during the golf swing allows the golfer to determine whether the hand grip and head of the training device continuously lie in a common plane during the golf swing.

17. A golf swing training device for a golfer comprising:

a shaft defining a longitudinal axis extending therethrough and having first and second ends with a hand grip on the first end and a head on the second end, said head being of a cylindrical configuration and having a central axis extending therethrough coincident to said longitudinal axis of said shaft and wherein said head, shaft and grip are of a total length substantially less than the distance to the ground when the golfer grips the hand grip in a stance for taking a practice golf swing;

a pair of lasers mounted in the head in a spaced relationship and oriented so as to emit a pair of parallel laser beams projecting in a direction away from the second end of said shaft so as to strike the ground during a golf swing, said beams being parallel to, spaced from opposed sides of, and lying in a common plane with an extension of said longitudinal axis of said shaft in said direction away from the second end of said shaft, and wherein said plane is coincident with a straight line extending between the points of intersection of said laser beams with the ground and oriented relative to the ground such that said straight line is perpendicular to a desired target line and representative of the orientation of a face of a golf club during a golf swing; and an electrical power source and circuit mounted in the device for selectively operating said pair of lasers for the golfer to practice golf swings by observing the alignment of said plane to the desired target line during at least a portion of the golf swing.

18. The device of 17 further comprising a spring biased switch disposed within said hand grip for selectively activating said pair of lasers, said switch being actuated to an position upon the golfer gripping the hand club for performing the practice swing and de-actuated to an off position upon the golfer releasing the hand grip.

19. A golf swing training device for a golfer comprising:

a shaft defining a longitudinal axis extending therethrough and having first and second ends with a hand grip on the first end and a head on the second end; said head being of a cylindrical configuration and having a central axis extending therethrough coincident to said longitudinal axis of said shaft and wherein said head, shaft and grip are of a total length substantially less than the distance to the ground when the golfer grips the hand grip in a stance for taking a practice golf swing;

a pair of lasers mounted in the head in a spaced relationship and oriented so as to emit a pair of parallel laser beams projecting in a direction away from the second end of said shaft so as to strike the ground during a golf swing, said beams being parallel to, spaced from opposed sides of, and lying in a common plane with an extension of said longitudinal axis of said shaft in said direction away from the second end of said shaft, and wherein said plane is coincident with a straight line extending between the points of intersection of said laser beams with the ground and oriented relative to the ground such that said straight line is perpendicular to a desired target line and representative of the orientation of a face of a golf club during a golf swing;

a third laser mounted in the grip and oriented so as to emit a third laser beam in a direction away from the first end of said shaft, said third laser beam being parallel to said first pair of laser beams and coincident with said longitudinal axis of said shaft whereby observing the path of said third laser relative to the paths of said pair of lasers during the golf swing allows the golfer to determine whether the hand grip and head of the training device continuously lie in a common plane during the golf swing;

an electrical power source and circuit mounted in the device for selectively operating said pair of lasers for the golfer to practice golf swings by observing the alignment of said plane to a desired target line during at least a portion of the golf swing; and a switch disposed within said hand grip for activating said lasers.

20. A golf swing training device for a golfer comprising:

a shaft defining a longitudinal axis extending therethrough and having first and second ends with a hand grip on the first end and a head on the second end, said head being of a cylindrical configuration and having a central axis extending therethrough coincident to said longitudinal axis of said shaft and wherein said head, shaft and grip are of a total length substantially less than the distance to the ground when the golfer grips the hand grip in a stance for taking a practice golf swing;

a pair of lasers mounted in the head in a spaced relationship and oriented so as to emit a pair of parallel laser beams disposed in a common plane and projecting in a direction away from the second end of said shaft so as to strike the ground during a golf swing, said beams being parallel to an extension of said longitudinal axis of said shaft in said direction away from the second end of said shaft, and wherein said plane is coincident with a straight line extending between the points of intersection of said laser beams with the ground and oriented relative to the ground such that said straight line is perpendicular to a desired target line and representative of the orientation of a face of a golf club during a golf swing;

an electrical power source and circuit mounted in the device for selectively operating said pair of lasers for the golfer to practice golf swings by observing the alignment of said plane to the desired target line during at least a portion of the golf swing; and a switch disposed within said hand grip and projecting laterally therefrom for selectively activating said pair of lasers.

* * * * *